US010147353B2

(12) United States Patent
Xiang et al.

(10) Patent No.: US 10,147,353 B2
(45) Date of Patent: Dec. 4, 2018

(54) ORGANIC LIGHT EMITTING DISPLAY PANEL AND PIXEL COMPENSATION METHOD

(71) Applicant: SHANGHAI TIANMA AM-OLED CO., LTD., Shanghai (CN)

(72) Inventors: Dongxu Xiang, Shanghai (CN); Yue Li, Shanghai (CN); Dong Qian, Shanghai (CN); Zeyuan Chen, Shanghai (CN); Gang Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/592,065

(22) Filed: May 10, 2017

(65) Prior Publication Data

US 2017/0249899 A1 Aug. 31, 2017

(30) Foreign Application Priority Data

Jan. 5, 2017 (CN) ..... 2017 1 0007512

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01); *G09G 2300/0842* (2013.01); *G09G 2300/0861* (2013.01); *G09G 2310/0245* (2013.01); *G09G 2310/0294* (2013.01); *G09G 2320/029* (2013.01); *G09G 2320/0233* (2013.01); *G09G 2320/043* (2013.01); *G09G 2320/045* (2013.01)

(58) Field of Classification Search
CPC ..... G09G 3/3231; G09G 3/3291
USPC ..... 345/76, 102, 174, 204–214, 690–694
See application file for complete search history.

(56) References Cited

U.S. PATENT DOCUMENTS 9,224,325 B1 * 12/2015 Fan ..... H05B 33/0842
2001/0026251 A1 * 10/2001 Hunter ..... G09G 3/325 345/55
2006/0066622 A1 * 3/2006 Steer ..... G09G 3/3233 345/504
2006/0176252 A1 * 8/2006 Date ..... G09G 3/3685 345/76

(Continued)

FOREIGN PATENT DOCUMENTS

CN 103280188 A 9/2013

OTHER PUBLICATIONS

Chinese, 1st Office Action dated Jul. 12, 2018.

*Primary Examiner* — Prabodh M Dharia
(74) *Attorney, Agent, or Firm* — Alston & Bird LLP

(57) ABSTRACT

An organic light emitting display panel and a pixel compensation method are provided. The organic light emitting display panel includes: a pixel array including pixel regions divided into M rows and N columns; a plurality of pixel driving circuits, each includes a light emitting diode and a driving transistor for driving the light emitting diode, and the light emitting diodes are located in the pixel regions; and a plurality of pixel compensation circuits configured to sample an anode voltage of the light emitting diode are in at least one of the pixel driving circuits. A light emitting current flows through the light emitting diode, and generates a compensation signal based on the anode voltage and the light emitting current.

9 Claims, 8 Drawing Sheets

(56) References Cited

U.S. PATENT DOCUMENTS

2007/0075939 A1* 4/2007 Cho ..... G09G 3/3233 345/76
2007/0080905 A1* 4/2007 Takahara ..... G09G 3/3233 345/76
2008/0284768 A1* 11/2008 Yoshida ..... G09G 3/2022 345/208
2009/0160740 A1* 6/2009 Leon ..... G09G 3/3291 345/76
2009/0207160 A1* 8/2009 Shirasaki ..... G09G 3/3233 345/212
2010/0060562 A1* 3/2010 Hadwen ..... H01L 31/02164 345/102
2010/0123699 A1* 5/2010 Leon ..... G09G 3/3233 345/211
2010/0225634 A1* 9/2010 Levey ..... G09G 3/3208 345/212
2014/0139565 A1* 5/2014 Choi ..... G09G 3/3233 345/691
2015/0009204 A1* 1/2015 Chaji ..... G09G 3/3233 345/214
2015/0070339 A1* 3/2015 Ahn ..... G09G 3/3233 345/211
2015/0077314 A1* 3/2015 Kim ..... G09G 3/3233 345/76
2015/0091858 A1* 4/2015 Rosenberg ..... G06F 3/0414 345/174
2016/0163266 A1* 6/2016 Lee ..... G09G 5/02 345/694
2016/0293107 A1* 10/2016 Jeong ..... G09G 3/3233

* cited by examiner

ORGANIC LIGHT EMITTING DISPLAY PANEL AND PIXEL COMPENSATION METHOD

CROSS-REFERENCE TO RELATED APPLICATION

This application is related to and claims priority from Chinese Patent Application No. CN201710007512.4, filed on Jan. 5, 2017, entitled "Organic Light Emitting Display Panel and Pixel Compensation Method," the entire disclosure of which is hereby incorporated by reference for all purposes.

TECHNICAL FIELD

The present disclosure relates to the field of display technology, and specifically to an organic light emitting display panel and a pixel compensation method.

BACKGROUND

With the continuous development of the display technology, the size of the display is ever-changing. In order to achieve portability of the electronic device, the demand on display screens having a small size is growing.

Meanwhile, the user also needs a display screen having a high display quality. For example, users prefer a high PPI (Pixel per Inch) display screen with improved display accuracy and consistency.

OLED (Organic Light-Emitting Diode) displays have been used more and more widely in a variety of portable electronic devices, since it has light, thin, low power consumption and other preferred characteristics.

The OLED display generally includes an organic light emitting diode array (i.e., a pixel array), driving circuits (i.e., pixel circuits) providing a driving current to the organic light emitting diodes in the array, and a scanning circuit providing a driving signal to the pixel circuits.

However, in the conventional OLED display, the pixel circuit usually compensates only for the threshold voltage (Vth) of the driving transistor, without considering the degradation of the carrier mobility in the driving transistor, that of the light emitting element and other issues caused by the accumulated service time. For example, as the time passes, when a current flows through the light emitting element, the forward voltage drop of the light emitting element (the minimum forward voltage at which the light emitting element can be turned on with a predetermined forward current) increases. The light emitting element is usually connected to the source/drain of the driving transistor, so that the potential difference between the source and the drain of the driving transistor decreases. Therefore, the light emitting current flowing through the light emitting element decreases. Since there are a plurality of light emitting elements and driving transistors in the OLED display, and the degradation of the respective light emitting elements and the change of the carrier mobility of the driving transistors are various, the display luminance of these light emitting elements is also various, even if an identical display signal is provided to each of the pixel circuits, and the display uniformity of the OLED display is further compromised.

SUMMARY

The present disclosure provides an organic light emitting display panel and a pixel compensation method, to solve the technical problems mentioned in the Background.

In a first aspect, an embodiment of the present disclosure provides an organic light emitting display panel comprising: a pixel array including pixel regions having M rows and N columns; a plurality of pixel driving circuits, each of the pixel driving circuits including a light emitting diode and a driving transistor for driving the light emitting diode, and each of the light emitting diodes being located in the pixel regions; and a plurality of pixel compensation circuits configured to sample an anode voltage of the light emitting diode in at least one of the pixel driving circuits and a light emitting current flowing through the light emitting diode, and generate a compensation signal based on the anode voltage and the light emitting current; the pixel compensation circuit including a first voltage sampling unit, a second voltage sampling unit and a calculation unit; the first voltage sampling unit including a sampling resistor and a first differential amplifier, the sampling resistor being arranged on a current path of the light emitting current, two input terminals of the first differential amplifier being electrically connected to two ends of the sampling resistor respectively, and generating the light emitting current based on a voltage difference between the two ends of the sampling resistor; the second voltage sampling unit being configured to sample the anode voltage of the light emitting diode; and the calculation unit being configured to determine the compensation signal based on the anode voltage and the light emitting current.

On a second aspect, an embodiment of the present disclosure provides a pixel compensation method applied to the above organic light emitting display panel. The pixel compensation method comprises: providing a reset signal to an anode of the light emitting diode and providing an initial data signal to a gate of the driving transistor; providing, by the driving transistor, a light emitting current to the light emitting diode; sampling the light emitting current and an anode voltage of the light emitting diode; and determining a compensation signal based on the light emitting current, the anode voltage of the light emitting diode and the initial data signal.

According to the present disclosure, the compensation for the threshold voltage, the carrier mobility of the driving transistor, and the degradation of the light emitting diode can be realized by sampling the anode voltage of the light emitting diode and the light emitting current in the pixel driving circuit, thus ensuring the display luminance uniformity of the organic light emitting display panel in both time and space dimensions.

BRIEF DESCRIPTION OF THE DRAWINGS

Other features, objectives and advantages of the present disclosure will become more apparent upon reading the detailed description to non-limiting embodiments with reference to the accompanying drawings, wherein.

DETAILED DESCRIPTION OF EMBODIMENTS

The present disclosure will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should be noted that the embodiments in the present disclosure and the features in the embodiments may be combined with each other on a non-conflict basis. The present disclosure will be described below in detail with reference to the accompanying drawings and in combination with the embodiments.

Figure 1:
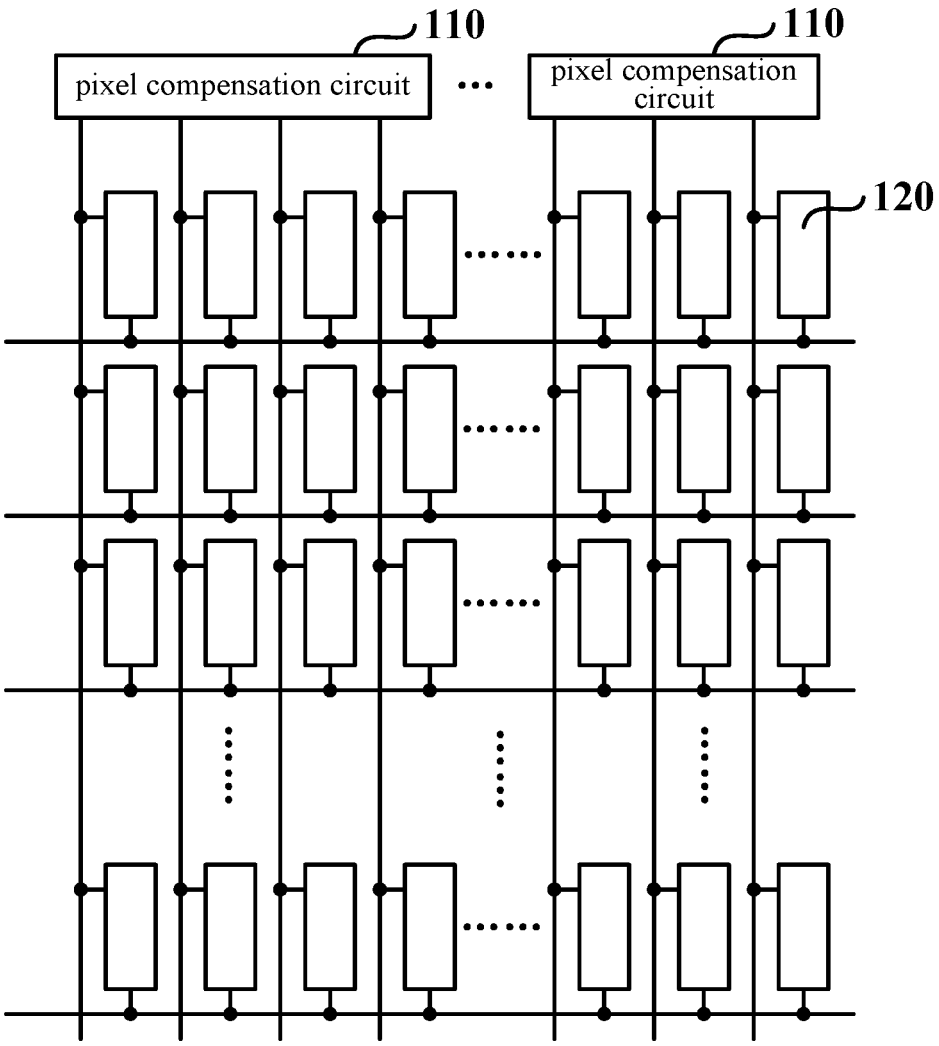
FIG. 1 shows a schematic structural diagram of an embodiment of an organic light emitting display panel of the present disclosure.

Referring to FIG. 1, is a schematic structural diagram of an embodiment of an organic light emitting display panel of the present disclosure.

The organic light emitting display panel of the present embodiment includes a pixel array, a plurality of pixel driving circuits (not shown), and a plurality of pixel compensation circuits 110.

Here, the pixel array includes pixel regions 120 having M rows and N columns. Each pixel driving circuit may include a light emitting diode and a driving transistor for driving the light emitting diode. Each light emitting diode is located within the pixel regions 120. In some alternative implementations, the pixel driving circuit may be arranged in each pixel region 120. By controlling the driving transistor in the pixel region 120 to turn on or off, the light emitting diode in the corresponding pixel region 120 may display a corresponding luminance.

The pixel compensation circuit 110 may be used to sample the anode voltage of the light emitting diode in at least one pixel driving circuit and the light emitting current flowing through the light emitting diode, and generate a compensation signal based on the anode voltage and the light emitting current.

In general, in the pixel driving circuit, one electrode of the source and drain of the driving transistor is electrically connected to the anode of the light emitting diode, and the other electrode of the source and drain of the driving transistor is normally connected to a fixed voltage. As a result, the light emitting current flowing through the light emitting diode is the current flowing through the source and drain of the driving transistor. On the other hand, there is a certain numerical relationship between the light emitting current and the carrier mobility and the threshold voltage of the driving transistor. Therefore, by detecting the light emitting current, the carrier mobility and the threshold voltage of the driving transistor can be determined correspondingly.

On the other hand, the cathode of the light emitting diode is usually connected to a fixed voltage (e.g., grounded). With the accumulation of service time, the light emitting diode will degrade to a certain extent, and the I (current)-V (voltage) ratio will change. While by sampling the light emitting current of the light emitting diode and the anode voltage of the light emitting diode, the current I-V ratio of the light emitting diode can be determined.

It can be seen from the above analysis that by sampling the anode voltage of the light emitting diode and the light emitting current flowing through the light emitting diode, it is possible to determine the current carrier mobility, the threshold voltage of the driving transistor, and the I-V ratio of the light emitting diode in the pixel driving circuit. As a result, the compensation signal can be determined based on the sampled anode voltage of the light emitting diode and the light emitting current flowing through the light emitting diode, and when the data signal is applied to each pixel driving circuit. When the data signal is applied to each pixel driving circuit, the data signal applied to each pixel driving circuit is compensated with the compensation signal, thereby improving the display luminance uniformity of the entire organic light emitting display panel.

The principle of the pixel compensation circuit of the present embodiment will be further described below with reference to FIG. 2.

Figure 2:
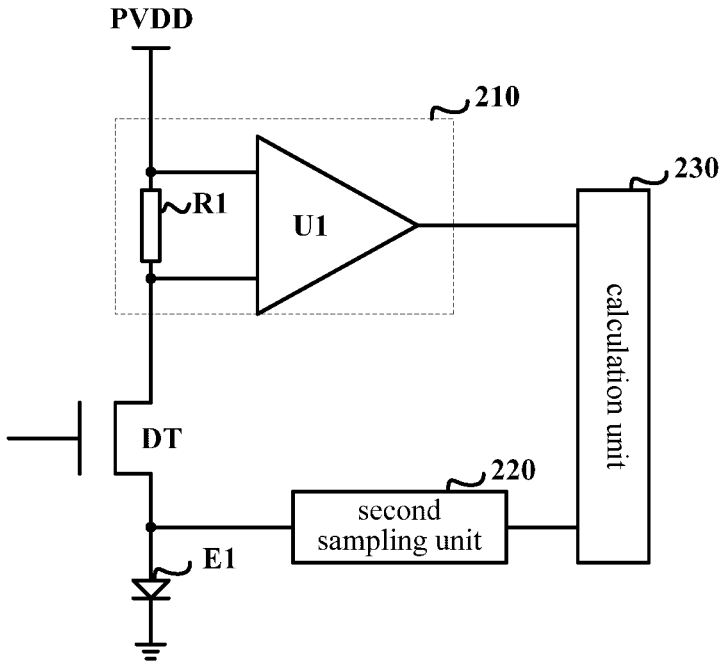
FIG. 2 shows a schematic diagram of the connection relationship between the pixel driving circuit and the pixel compensation circuit of an embodiment in the organic light emitting display panel of the present disclosure.

FIG. 2 shows a schematic diagram of the connection relationship between the pixel driving circuit and the pixel compensation circuit of an embodiment in the organic light emitting display panel of the present disclosure.

In FIG. 2, the pixel compensation circuit includes a first voltage sampling unit 210, a second voltage sampling unit 220 and a calculation unit 230.

The first voltage sampling unit 210 may include a sampling resistor R1 and a first differential amplifier U1. Here, the sampling resistor R1 is arranged on the current path of the light emitting current. For example, the sampling resistor R1 may be arranged between a fixed voltage signal terminal PVDD and the first electrode of the driving transistor DT. The two input terminals of the first differential amplifier U1 are electrically connected to two ends of the sampling resistor R1, and the light emitting current is determined based on the voltage difference between two ends of the sampling resistor R1.

The second voltage sampling unit 220 is for sampling the anode voltage of the light emitting diode E1. The calculation unit 230 is for determining the compensation signal based on the anode voltage and the light emitting current.

As a result, the current carrier mobility, the threshold voltage of the driving transistor, and the I-V ratio of the light emitting diode in the pixel driving circuit can be determined based on that the first voltage sampling unit 210 samples the light emitting current of the light emitting diode and the second voltage sampling unit 220 samples the anode voltage flowing through the light emitting diode. Based on the sampled anode voltage of the light emitting diode and the light emitting current flowing through the light emitting diode, the compensation signal is determined. When the data signal is applied to each pixel driving circuit, the data signal applied to each pixel driving circuit is compensated with the compensation signal, thereby improving the display luminance uniformity of the entire organic light emitting display panel.

Figure 3:
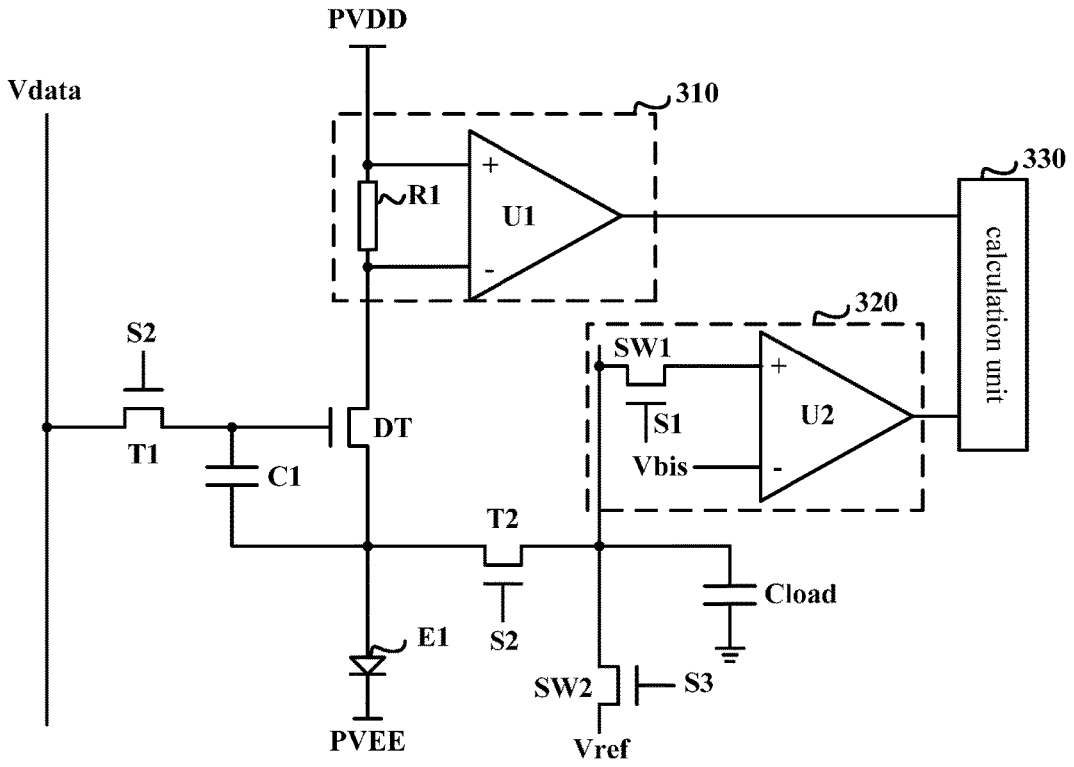
FIG. 3 shows a schematic diagram of the connection relationship between the pixel driving circuit and the pixel compensation circuit of another embodiment in the organic light emitting display panel of the present disclosure.

Referring to FIG. 3, a schematic diagram of the connection relationship between the pixel driving circuit and the pixel compensation circuit of another embodiment in the organic light emitting display panel of the present disclosure is shown.

Similarly to FIG. 2, in the present embodiment, the pixel driving circuit also includes a driving transistor DT and a light emitting diode E1, the pixel compensation circuit also includes a first voltage sampling unit 310, a second voltage sampling unit 320 and a calculation unit 330, and the use of the respective components is similar to that of the embodiment shown in FIG. 2.

Unlike the embodiment shown in FIG. 2, in the present embodiment, the second voltage sampling unit 320 may include a first switching transistor SW1 and a second differential amplifier U2.

Here, the gate of the first switching transistor SW1 is electrically connected to a first control signal terminal S1. The first electrode of the first switching transistor SW1 is electrically connected to the anode of the light emitting diode E1. The second electrode of the first switching transistor SW1 and an output terminal of the second differential amplifier U2 are electrically connected. The other input end of the second differential amplifier U2 may be electrically connected to a voltage signal terminal that provides a fixed level.

In addition, in the present embodiment, the circuit structure of the pixel driving circuit is further schematically described. Specifically, the pixel driving circuit may include a first transistor T1, a second transistor T2 and a first capacitor C1. Here, the gate of the first transistor T1 is electrically connected to a second control signal terminal S2. The first electrode of the first transistor T1 is electrically connected to a data voltage signal line Vdata. The second electrode of the first transistor T1 is electrically connected to the gate of the driving transistor DT. The first electrode of the driving transistor DT is electrically connected to the first voltage signal terminal PVDD. The second electrode of the driving transistor DT is electrically connected to the anode of the light emitting diode E1 and the first electrode of the second transistor T2. The gate of the second transistor T2 is electrically connected to the second control signal terminal S2. The second electrode of the second transistor T2 is electrically connected to the first electrode of the first switching transistor SW1. The cathode of the light emitting diode E1 is electrically connected to a second voltage signal terminal PVEE.

In the present embodiment, the sampling resistor R1 in the pixel compensation circuit may be arranged, for example, between the first voltage signal terminal PVDD and the first electrode of the driving transistor DT.

In addition, in some alternative implementations of the present embodiment, in order to realize the sampling of the anode voltage of the light emitting diode E1, the pixel compensation circuit of the present embodiment further includes a second switching transistor SW and a first compensation capacitor Cload.

The gate of the second switching transistor SW2 is electrically connected to a third control signal terminal S3. The first electrode of the second switching transistor SW2 is electrically connected to a reference voltage signal line Vref. The second electrode of the second switching transistor SW2 is electrically connected to the first electrode of the first switching transistor SW1. One end of the first compensation capacitor Cload is grounded and the other end is electrically connected to the first electrode of the first switching transistor SW1.

In these alternative implementations, the anode voltage signal of the light emitting diode E1 may be stored in the first compensation capacitor Cload and provided to an input terminal of the second differential amplifier U2 when the first switching transistor SW1 is turned on.

Figure 4:
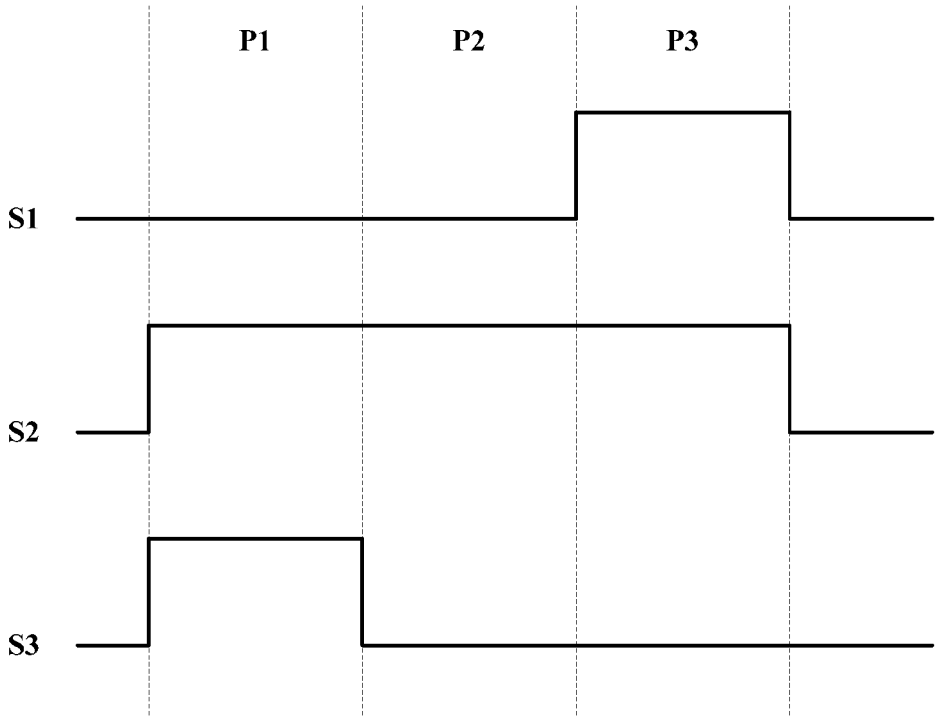
FIG. 4 shows a schematic timing sequence diagram of each control signal in the embodiment shown in FIG. 3.

Hereinafter, the operation principle of the pixel compensation circuit in the present embodiment will be further described in connection with the timing sequence diagram shown in FIG. 4. In the following description, the transistors in FIG. 3 are schematically shown as NMOS transistors for illustration purpose.

Specifically, in the P1 phase, the first control terminal S1 inputs a low level signal, the second control terminal S2 inputs a high level signal, and the third control terminal S3 inputs a high level signal. At this time, the first transistor T1, the second transistor T2, and the second switching transistor SW2 are turned on to provide the data signal provided from the data signal line Vdata to the gate of the driving transistor DT, and provide a reference voltage signal to the anode of the light emitting diode E1, and the pixel driving circuit is reset.

Next, in the P2 phase, the first control terminal S1 inputs a low level signal, the second control terminal S2 inputs a high level signal, and the third control terminal S3 inputs a low level signal. At this time, the first transistor T1 and the second transistor T2 are turned on. A current is generated due to a voltage difference between the gate voltage (data signal) and the source voltage (reference voltage signal) of the driving transistor DT. The first compensation capacitor Cload is in a suspended state due to the turning off of the first switching transistor SW1 and the second switching transistor SW2 in the P2 phase. In addition, the reference voltage signal is lower than the cathode voltage of the light emitting diode E1. Thus, the current flows through the second transistor T2 to the first compensation capacitor Cload. As a result, the current flows through the second transistor T2 into the first compensation capacitor Cload until the voltage on the first compensation capacitor Cload is equal to the anode voltage of the light emitting diode E1, so that the first compensation capacitor Cload completes the sampling of the anode voltage of the light emitting diode E1.

Next, in the P3 phase, the first control terminal S1 inputs a high level signal, the second control terminal S2 inputs a high level signal, and the third control terminal S3 inputs a low level signal. At this time, the first transistor T1, the second transistor T2, the first switching transistor SW1 and the driving transistor DT are turned on. At this time, since the potential of one end of the first compensation capacitor Cload is equal to the anode potential of the light emitting diode E1, the light emitting current flows all through the light emitting diode E1. As a result, the light emitting current Ids can be determined by sampling the voltage on two ends of the sampling resistor R1 arranged on the light emitting current path.

Hereinafter, it will be further described how to determine the compensation signal by the anode voltage of the light emitting diode E1 and the light emitting current Ids sampled by the pixel compensation circuit.

When the driving transistor DT is in the saturation region, the current Ids can be determined by the following equation (1):

$$Ids=\tfrac{1}{2}\mu C_{ox}W/L(Vgs-|Vth|)^2 \quad (1)$$

Here, μ is the carrier mobility of the driving transistor DT;

Cox is the capacity of the gate oxide layer capacitance per unit area of the driving transistor DT, which is a fixed value;

Vgs is the difference between the gate voltage (Vg) and the source voltage (Vs) of the driving transistor DT, and since the gate voltage of the driving transistor DT is the data voltage signal Vdata in the P2 and P3 phases, here Vgs=Vdata−Vs;

W/L is the width and length ratio of the driving transistor DT, which is a fixed value;

Vth is the threshold voltage of the driving transistor DT.

Through the P1 to P3 phases described above, the current Ids and the source voltage Vs of the driving transistor DT can be obtained, and the Cox, Vdata or W/L is a known amount. As a result, two equations with the carrier mobility μ and the threshold voltage Vth as unknown quantities can be obtained by sampling two times the light emitting currents Ids1 and Ids2 and sampling two times the anode voltages Vs1 and Vs2 of the light emitting diodes E1. By combining these two equations, it is possible to solve the specific value of the carrier mobility μ and the threshold voltage Vth of the driving transistor DT.

On the other hand, by repeatedly sampling the anode voltage of the light emitting diode E1 and the light emitting current Ids, the calculation unit can further determine the volt-ampere characteristic curve of the light emitting diode E1 to determine the correspondence between the display luminance, the light emitting current Ids and the anode voltage of the light emitting diode E1.

As a result, when it is desired that the light emitting diodes in a certain pixel region display a certain luminance, the value of the light emitting current Ids may be determined based on the correspondence between the display luminance and the light emitting current Ids, and then Ids, μ, Vth, Cox, W/L may be taken into the above equation (1), the value of Vgs is obtained. Also, due to Vgs=Vdata−Vs, and Vs can be obtained through the volt-ampere characteristic curve of the light emitting diode E1, the compensated Vdata value can be eventually obtained.

As a result, through the pixel compensation circuit, the threshold voltage, the carrier mobility of the driving transistor and the degradation of the light emitting diode can be compensated, thus ensuring the display luminance uniformity of the organic light emitting display panel in both time and space dimensions.

Specifically, since the pixel compensation circuit of the present embodiment compensates the threshold voltage and the carrier mobility of the driving transistor, it is possible to avoid the differences in the threshold voltages and carrier mobility of the driving transistors due to varied manufacturing, causing different display luminance even when the identical data signal is provided to these driving transistors. The uniformity of the display luminance is achieved in space (i.e., in different regions of the panel).

On the other hand, since the pixel compensation circuit of the present embodiment also compensates for the degradation of the light emitting diode, it is possible to avoid that the luminance of the light emitting diode becomes lower and lower over time when the same anode voltage is provided. The uniformity of the display luminance is also achieved in time.

In some alternative implementations, for example, the Vdata values corresponding to each level of luminance may be stored in the memory of the integrated circuit. When a certain level of luminance is required, the integrated circuit may read the data voltage value corresponding to the luminance in the memory and provide the data voltage value to the corresponding pixel driving circuit.

Figure 5:
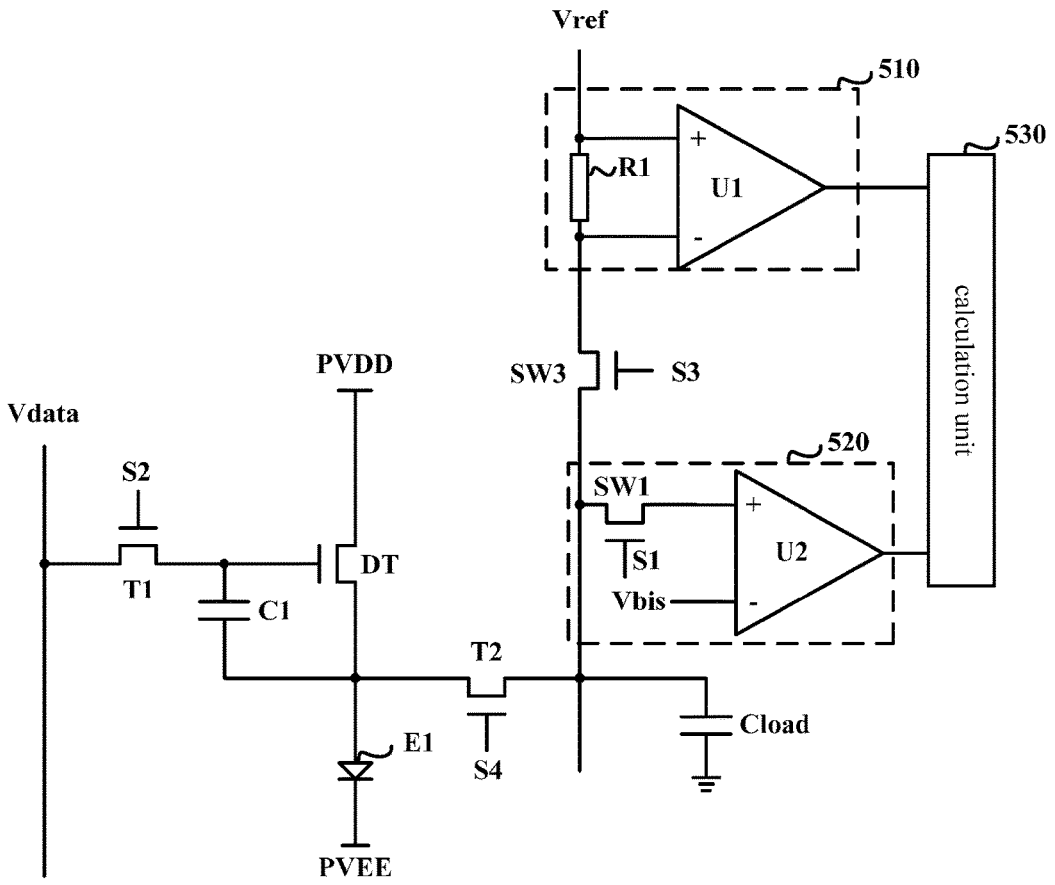
FIG. 5 shows a schematic diagram of the connection relationship between the pixel driving circuit and the pixel compensation circuit of another embodiment in the organic light emitting display panel of the present disclosure.

Referring to FIG. 5, is a schematic diagram of the connection relationship between the pixel driving circuit and the pixel compensation circuit of another embodiment in the organic light emitting display panel of the present disclosure.

Similarly to FIG. 2, in the present embodiment, the pixel driving circuit also includes a driving transistor DT and a light emitting diode E1, the pixel compensation circuit also includes a first voltage sampling unit 510, a second voltage sampling unit 520 and a calculation unit 530, and the use of the respective components is similar to that of the embodiment shown in FIG. 2.

In addition, similarly to the embodiment shown in FIG. 3, in the present embodiment, the pixel driving circuit also includes a first transistor T1, a second transistor T2 and a first capacitor C1.

Here, the gate of the first transistor T1 is electrically connected to the second control signal terminal S2. The first electrode of the first transistor T1 is electrically connected to the data voltage signal line Vdata. The second electrode of the first transistor T1 is electrically connected to the gate of the driving transistor DT. The first electrode of the driving transistor DT is electrically connected to the first voltage signal terminal PVEE. The second electrode of the driving transistor DT is electrically connected to the anode of the light emitting diode E1 and the first electrode of the second transistor T2. The cathode of the light emitting diode E1 is electrically connected to the second voltage signal terminal PVEE. The second electrode of the second transistor T2 is electrically connected to the first electrode of the first switching transistor SW1.

Unlike the embodiment shown in FIG. 3, in the present embodiment, the gate of the second transistor T2 is electrically connected to a fourth control signal terminal S4.

In addition, in the present embodiment, the sampling resistor T1 is arranged on the reference voltage signal line Vref. The pixel compensation circuit also includes a third switching transistor SW3. The gate of the third switching transistor SW3 is electrically connected to the third control signal terminal S3. The first electrode of the third switching transistor SW3 is electrically connected to one end of the sampling resistor R1. The second electrode of the third switching transistor SW3 is electrically connected to the first electrode of the first switching transistor SW1.

Figure 6:
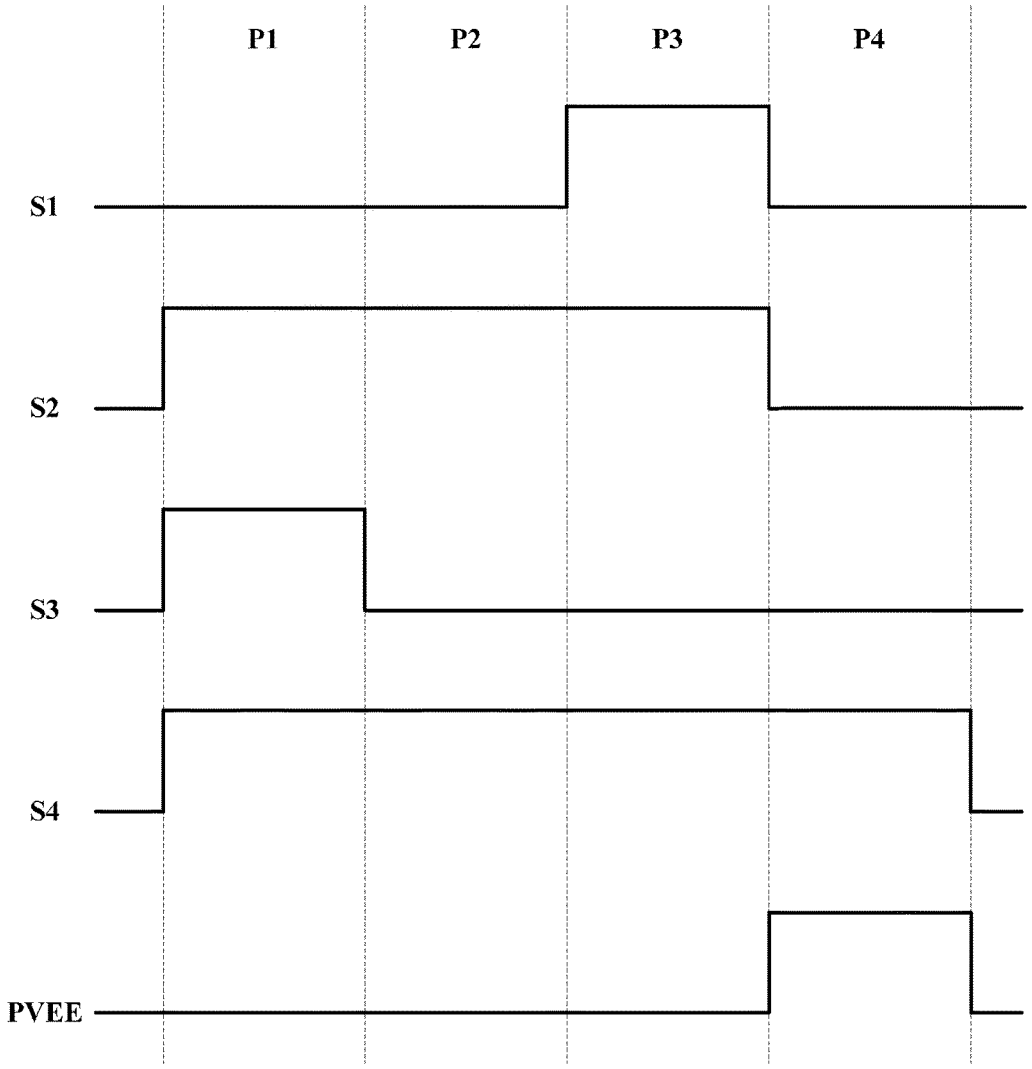
FIG. 6 shows a schematic timing sequence diagram of each control signal in the embodiment shown in FIG. 5.

Hereinafter, the operation principle of the pixel compensation circuit in the present embodiment will be further described in connection with the timing sequence diagram shown in FIG. 6. In the following description, the transistors in FIG. 5 are schematically shown as NMOS transistors for illustration purpose.

Specifically, in the P1 phase, the first control terminal S1 provides a low level signal, the second control terminal S2, the third control terminal S3 and the fourth control terminal provides a high level signal. At this time, the first transistor T1, the second transistor T2, and the third switching transistor SW3 are turned on to provide the data signal provided by the data signal line Vdata to the gate of the driving transistor DT, and provide the reference voltage signal to the anode of the light emitting diode E1, and the pixel driving circuit is reset.

Next, in the P2 phase, the first control terminal S1 and the third control terminal S3 provide a low level signal, the second control terminal S2 and the fourth control terminal S4 provide a high level signal. At this time, the first switching transistor SW1 and the third switching transistor SW3 are turned off, the first transistor T1 and the second transistor T2 are turned on. A current is generated due to a voltage difference between the gate voltage (data signal) and the source voltage (reference voltage signal) of the driving transistor DT. Further, the first compensation capacitor Cload is in a suspended state due to the turning off of the first switching transistor SW1 and the second switching transistor SW2 in the P2 phase. In addition, since the reference voltage signal is lower than the cathode voltage of the light emitting diode E1, the current flows through the second transistor T2 to the first compensation capacitor Cload. As a result, the current flows through the second transistor T2 before the voltage on the first compensation capacitor Cload is equal to the anode voltage of the light emitting diode E1, so that the first compensation capacitor Cload samples the anode voltage of the light emitting diode E1.

Next, in the P3 phase, the first control terminal S1, the second control terminal S2 and the fourth control terminal provide a high level signal, and the third control terminal S3 provides a low level signal. At this time, the first transistor T1, the second transistor T2 and the first switching transistor SW1 are turned on, the third switching transistor SW3 is turned off. The anode voltage of the light emitting diode E1 sampled by the first compensation capacitor Cload may be provided to the second voltage sampling unit 520.

Next, in the P4 phase, the first control terminal S1 and the second control terminal S2 provide a low level signal, and the fourth control terminal S4 and the third control terminal S3 provide a high level signal. At this time, the first transistor T1 and the first switching transistor SW1 are turned off, and the second transistor T2 and the third switching transistor SW3 are turned on. At the same time, the second voltage signal terminal electrically connected to the cathode of the light emitting diode E1 provides a high level signal, so that the light emitting current Ids flows through the sampling resistor R1 through the second transistor T2 and the third switching transistor SW3.

As can be seen from the above description, the pixel compensation circuit may sample the anode voltage of the light emitting diode E1 and the light emitting current of the light emitting diode E1 through the above P1 to P4 phases. As a result, the specific values of the carrier mobility μ and the threshold voltage Vth of the driving transistor can be solved with the above equation (1) by at least two samplings. On the other hand, by repeatedly sampling the anode voltage of the light emitting diode E1 and the light emitting current Ids, the calculation unit can further determine the volt-ampere characteristic curve of the light emitting diode E1 to determine the correspondence between the display luminance, the light emitting current Ids and the anode voltage of the light emitting diode E1, as a basis for correcting the data voltage signal provided on the data voltage signal line.

Figure 7:
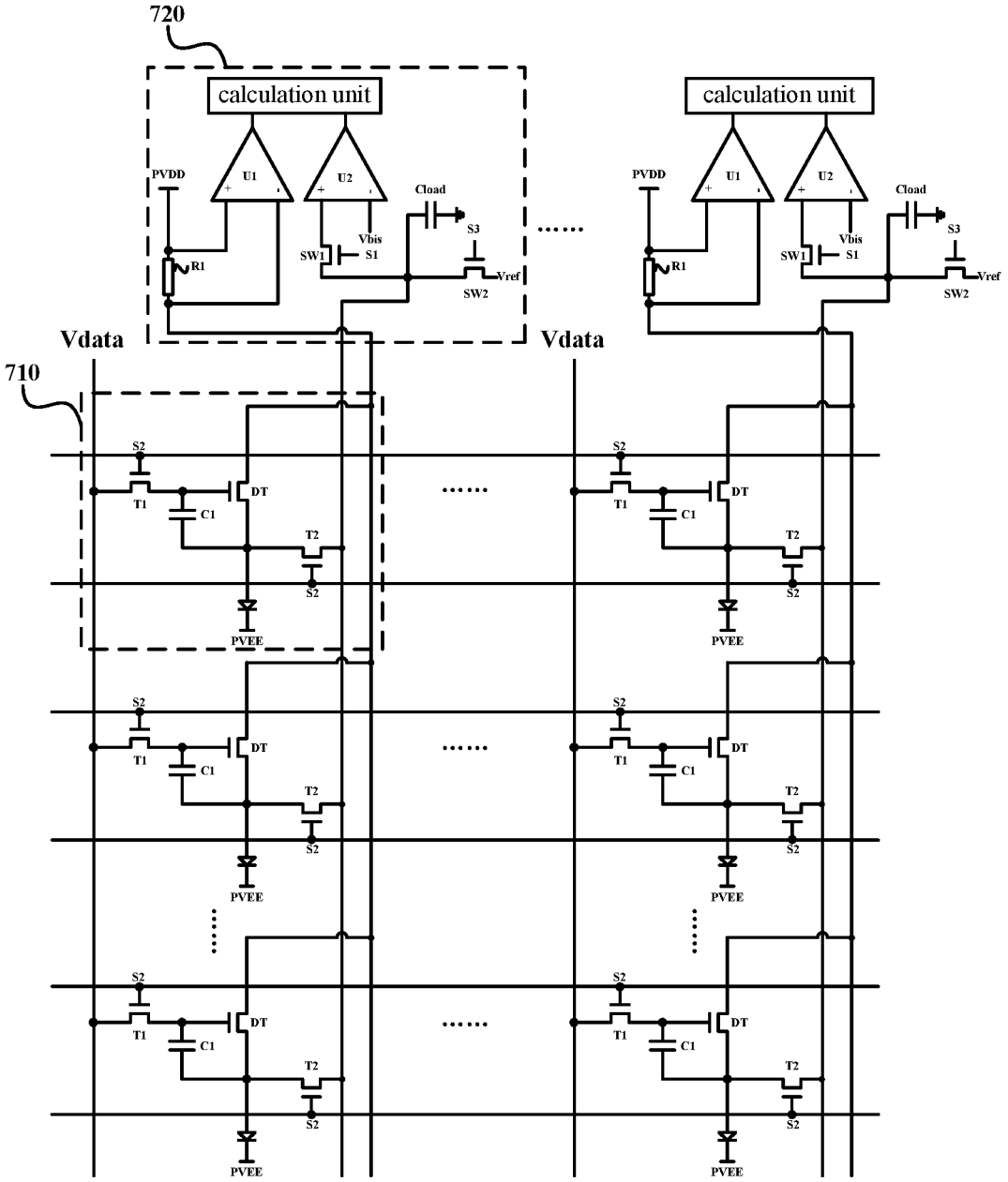
FIG. 7 shows a schematic structural diagram of another embodiment of the organic light emitting display panel of the present disclosure.

Referring to FIG. 7, is a schematic structural diagram of another embodiment of the organic light emitting display panel of the present disclosure.

Similarly to the organic light emitting display panel shown in FIG. 1, the organic light emitting display panel of the present embodiment also includes a pixel array, a plurality of pixel driving circuits 710, and a plurality of pixel compensation circuits 720.

Unlike the embodiment shown in FIG. 1, in the organic light emitting display panel of the present embodiment, each pixel compensation circuit 720 is used to sample the anode voltage of the light emitting diode in each pixel driving circuit 710 corresponding to the pixel regions of the same column and the light emitting current flowing through the light emitting diode. That is, in the pixel array, the pixel driving circuits 710 in a certain pixel region column are electrically connected to the same pixel compensation circuit 720.

As a result, the pixel compensation circuit 720 may sample, at different times, the anode voltage of the light emitting diode in each of the pixel driving circuits 710 electrically connected thereto and the light emitting current flowing through the light emitting diode. When calculating the compensation signal, for example, the compensation signal may be calculated for the driving transistor and the light emitting diode in each pixel region, or the average value of the threshold voltages of the respective driving transistors of the same column may be calculated as the common threshold voltage of the driving transistors of the present column, and the common luminance-current curve for the light emitting diodes of the present column may be determined by synthesizing the luminance-current curves of the respective light emitting diodes of the column.

By electrically connecting the same column of pixel driving circuits 710 with the same pixel compensation circuit 720, it is possible to reduce the number of pixel compensation circuits 720 as much as possible while ensuring the pixel compensation effect, thereby reducing the layout area of the organic light emitting display panel occupied by the pixel compensation circuit 720. On the other hand, since the pixel compensation circuit 720 is normally arranged in the non-display area of the organic light emitting display panel, it is possible to reduce the space occupied by the non-display area and facilitate the realization of a narrow border of the organic light emitting display panel.

Figure 8:
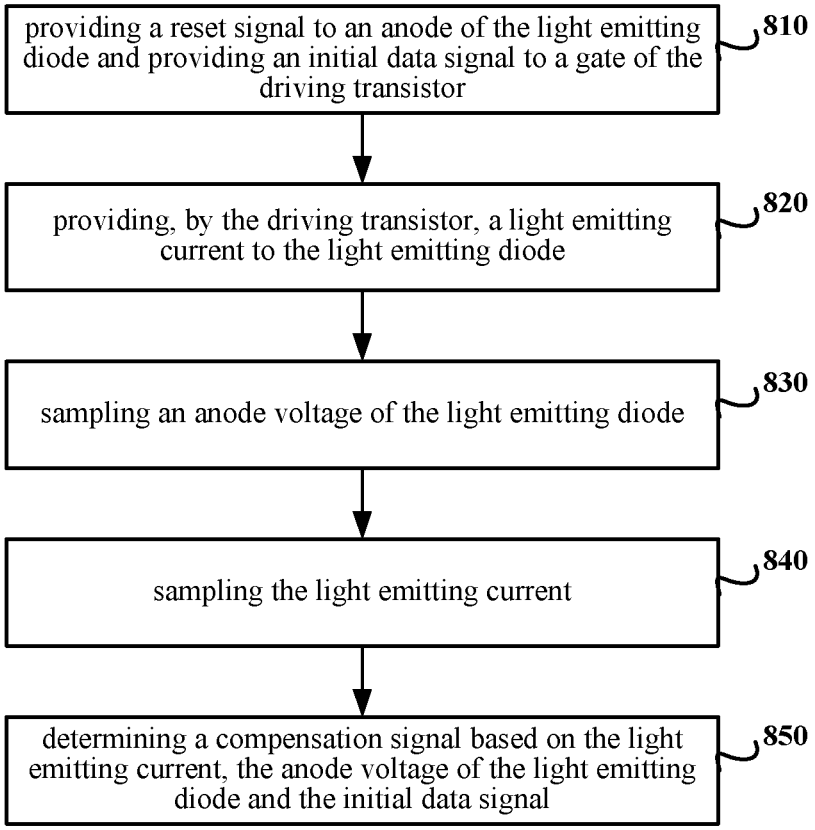
FIG. 8 shows a schematic flowchart of an embodiment of a pixel compensation method of the present disclosure.

Referring to FIG. 8, is a schematic flowchart of an embodiment of a pixel compensation method of the present disclosure. The pixel compensation method of the present embodiment may be applied to the organic light emitting display panel described in any one of the above embodiments.

The pixel compensation method of the present embodiment includes:

In step 810, a reset signal is provided to the anode of the light emitting diode and an initial data signal is provided to the gate of the driving transistor.

In step 820, the driving transistor provides a light emitting current to the light emitting diode.

In step 830, the anode voltage of the light emitting diode is sampled.

In step 840, the light emitting current is sampled.

In step 850, a compensation signal is determined based on the light emitting current, the anode voltage of the light emitting diode and the initial data signal.

By the steps 810 to 850 as described above, the anode voltage of the light emitting diode and the light emitting current in the pixel driving circuit can be sampled. By the above equation (1), it is possible to determine the threshold voltage, the carrier mobility of the driving transistor and the volt-ampere characteristic curve of the light emitting diode in the pixel driving circuit. As a result, when a light emitting diode in a certain pixel region is desired to display a certain luminance, the value of the light emitting current Ids can be determined based on the correspondence between the display luminance and the light emitting current Ids, and the value of the data voltage can be obtained by inverse solution of the above equation (1).

In addition, the pixel compensation method of the present embodiment may further include:

In step 860, a data voltage signal is provided to the gate of the driving transistor to cause the light emitting diode to emit light, wherein the data voltage signal is a voltage signal compensated by the compensation signal.

As a result, compensation to the threshold voltage, the carrier mobility of the driving transistor and to the degradation of the light emitting diode can be achieved by providing the data voltage signal compensated by the compensation signal to the gate of the driving transistor in each pixel driving circuit, thereby ensuring the display luminance uniformity of the organic light emitting display panel in both time and space dimensions.

It should be appreciated by those skilled in the art that the inventive scope of the present disclosure is not limited to the technical solutions formed by the particular combinations of the above technical features. The inventive scope should also cover other technical solutions formed by any combinations of the above technical features or equivalent features thereof without departing from the concept of the invention, such as, technical solutions formed by replacing the features as disclosed in the present disclosure with (but not limited to), technical features with similar functions.

What is claimed is:

1. An organic light emitting display panel, comprising:

a pixel array comprising pixel regions divided into M rows and N columns;

a plurality of pixel driving circuits, each including a light emitting diode, a driving transistor for driving the light emitting diode, wherein each of the light emitting diodes is located in one of the pixel regions; and a plurality of pixel compensation circuits each associated with one of the pixel driving circuits, configured to sample an anode voltage of the light emitting diode in one associated pixel driving circuits and a light emitting current flowing through the light emitting diode, and generate a compensation signal based on the anode voltage and the light emitting current, wherein the pixel compensation circuit comprises a first voltage sampling unit, a second voltage sampling unit and a calculation unit, wherein the first voltage sampling unit comprises a sampling resistor and a first differential amplifier, wherein the sampling resistor is arranged on a current path of the light emitting current, wherein two input terminals of the first differential amplifier are electrically connected to two ends of the sampling resistor respectively, and wherein the light emitting current is determined based on a voltage difference between the two ends of the sampling resistor, wherein the second voltage sampling unit is configured to sample the anode voltage of the light emitting diode, wherein the calculation unit is configured to determine the compensation signal based on the anode voltage and the light emitting current;

wherein the second voltage sampling unit comprises a first switching transistor and a second differential amplifier;

wherein a gate of the first switching transistor is electrically connected to a first control signal terminal, wherein a first electrode of the first switching transistor is electrically connected to an anode of the light emitting diode; wherein a second electrode of the first switching transistor is electrically connected to an output terminal of the second differential amplifier;

wherein the pixel compensation circuit further comprises a first compensation capacitor; and wherein an end of the first compensation capacitor is grounded and the second end of the first compensation capacitor is electrically connected to the first electrode of the first switching transistor.

2. The organic light emitting display panel according to claim 1, wherein the pixel driving circuit further comprises a first transistor, a second transistor and a first capacitor;

wherein a gate of the first transistor is electrically connected to a second control signal terminal, wherein a first electrode of the first transistor is electrically connected to a data voltage signal line, and wherein a second electrode of the first transistor is electrically connected to the gate of the driving transistor;

wherein a first electrode of the driving transistor is electrically connected to a first voltage signal terminal, and a second electrode of the driving transistor is electrically connected to the anode of the light emitting diode and a first electrode of the second transistor;

wherein a gate of the second transistor is electrically connected to the second control signal terminal, and a second electrode of the second transistor is electrically connected to the first electrode of the first switching transistor; and wherein a cathode of the light emitting diode is electrically connected to a second voltage signal terminal.

3. The organic light emitting display panel according to claim 1, wherein the sampling resistor is arranged between the first voltage signal terminal and the first electrode of the driving transistor.

4. The organic light emitting display panel according to claim 3, wherein the pixel compensation circuit further comprises a second switching transistor, wherein a gate of the second switching transistor is electrically connected to a third control signal terminal, wherein a first electrode of the second switching transistor is electrically connected to a reference voltage signal line, and wherein a second electrode of the second switching transistor is electrically connected to the first electrode of the first switching transistor.

5. The organic light emitting display panel according to claim 4,

Wherein the sampling resistor is arranged on a reference voltage signal line;

wherein the pixel compensation circuit further comprises a third switching transistor, wherein a gate of the third switching transistor is electrically connected to a third control signal terminal, a first electrode of the third switching transistor is electrically connected to an end of the sampling resistor, and a second electrode of the third switching transistor is electrically connected the first electrode of the first switching transistor.

6. The organic light emitting display panel according to claim 1, wherein the pixel driving circuit further includes a first transistor, a second transistor and a first capacitor;

a gate of the first transistor is electrically connected to a second control signal terminal, a first electrode of the first transistor is electrically connected to a data voltage signal line, and a second electrode of the first transistor is electrically connected to the gate of the driving transistor;

a first electrode of the driving transistor is electrically connected to a first voltage signal terminal, and a second electrode of the driving transistor is electrically connected to the anode of the light emitting diode and a first electrode of the second transistor;

a gate of the second transistor is electrically connected to a fourth control signal terminal, and a second electrode of the second transistor is electrically connected to the first electrode of the first switching transistor; and a cathode of the light emitting diode is electrically connected to a second voltage signal terminal.

7. The organic light emitting display panel according to claim 1, wherein the pixel compensation circuits each is configured to sample the anode voltage and the light emitting current flowing through the light emitting diode, in the associated pixel region of the same column.

8. A pixel compensation method applied to the organic light emitting display panel according to claim 1, comprising:

providing a reset signal to the anode of the light emitting diode and providing an initial data signal to the gate of the driving transistor;

providing, by the driving transistor, the light emitting current to the light emitting diode;

sampling the light emitting current and the anode voltage of the light emitting diode; and determining a compensation signal based on the light emitting current, the anode voltage of the light emitting diode and the initial data signal.

9. The pixel compensation method according to claim 8, further comprising:

providing a data voltage signal to the gate of the driving transistor to cause the light emitting diode to emit light, wherein the data voltage signal is a voltage signal compensated by the compensation signal.

* * * * *